US005194726A

United States Patent [19]

Jonkman

[11] Patent Number: 5,194,726

[45] Date of Patent: Mar. 16, 1993

[54] X-RAY IMAGING SYSTEM WITH OBSERVABLE IMAGE DURING CHANGE OF IMAGE SIZE

[75] Inventor: Rudi Jonkman, Eindhoven, Netherlands

[73] Assignee: U.S. Philips Corp., New York, N.Y.

[21] Appl. No.: 898,765

[22] Filed: Jun. 9, 1992

[30] Foreign Application Priority Data

Jun. 17, 1991 [EP] European Pat. Off. ..... 91201514.6

[51] Int. Cl.[5] ..... H01J 31/50; H05G 1/64

[52] U.S. Cl. ..... 250/214 VT; 378/99; 358/111

[58] Field of Search ..... 250/213 VT, 207, 214 AG; 378/99, 62, 150–153; 358/111; 313/523–530, 532–537

[56] References Cited

U.S. PATENT DOCUMENTS

| | | | |
|---|---|---|---|
| 3,872,302 | 3/1975 | Fender | 250/213 VT |
| 4,346,326 | 8/1982 | Driard et al. | 250/213 VT |
| 4,809,309 | 2/1989 | Beekmans | 250/213 VT |
| 4,935,946 | 6/1990 | Hefter et al. | 378/99 |
| 4,943,988 | 7/1990 | Gerlach et al. | 378/99 |
| 5,050,198 | 9/1991 | Honda | 378/99 |
| 5,117,446 | 5/1992 | Haaker et al. | 378/99 |

*Primary Examiner*—David C. Nelms
*Assistant Examiner*—Michael Messinger
*Attorney, Agent, or Firm*—Jack D. Slobod

[57] ABSTRACT

The invention relates to an X-ray imaging system, comprising an X-ray image intensifier tube in which the electron-optical system can be adjusted to a number of different image formats. By making the image format increase or decrease visibly on the exit screen in the event of a change of image format, annoying visual adjustment effects are avoided and a patient can be continuously observed also in the event of a change of format. Because of the gradual high-voltage variation of the power supply for the electron-optical system, associated with a visible variation of the image format, the output resistance of the power supply circuit may be high. Furthermore, due to the gradual change of the mean intensity on the exit screen of the X-ray image intensifier tube, the control behavior of the automatic exposure control and the automatic gain control of the X-ray imaging system are influenced in a positive sense.

13 Claims, 4 Drawing Sheets

X-RAY IMAGING SYSTEM WITH OBSERVABLE IMAGE DURING CHANGE OF IMAGE SIZE

BACKGROUND OF THE INVENTION

1. Field of the Invention

The invention relates to an X-ray imaging system, including an X-ray source for emitting an X-ray beam for irradiating an object to be arranged within the X-ray beam so as to form an X-ray image, an X-ray image intensifier tube, having an entrance screen for the detection of the X-ray image and the emission of electrons, an exit screen, and an electron-optical system for imaging the X-ray image detected on the entrance screen as an optical image onto the exit screen, and adjusting means for adjusting the electron-optical system so as to image surface portions ($r_1$, $r_2$) of different size of the entrance screen onto the exit screen.

The invention also relates to an X-ray image intensifier tube and to adjusting means suitable for use in such an X-ray imaging system.

An X-ray imaging system of the kind set forth is known from: B. van der Eijk and W. Kühl: "An X-ray Image intensifier with large input format"; Philips Technical Review, Vol. 41, 1983/84, No. 5, pp. 137–148.

The cited article describes an X-ray imaging system comprising an X-ray image intensifier tube which converts X-rays formed in a CsI entrance screen into blue light which releases electrons in a photocathode. Using four electrodes, said electrons are accelerated and imaged on an exit screen. The exit screen, having a comparatively small diameter amounting to a few cm, comprises a phosphor layer which is vapour-deposited on a fibre-optical system and in which the electrons cause luminescence. The optical image formed on the exit screen is picked up, for example by means of a television camera so as to be displayed on a television monitor or is recorded on a 100 mm photographic film. Depending on the dimensions of the object to be imaged, different diameters of the entrance screen of the X-ray image intensifier tube are used. For example, the imaging of the kidneys or the stomach requires a large surface portion of the X-ray image intensifier tube entrance screen which has a diameter of, for example 38 cm, whereas for the imaging of smaller objects, such as a single kidney, a smaller surface portion having a diameter of, for example 17 cm is required. When the image format is adapted, the entire exit screen is still utilized, so that the magnification is changed. When a smaller surface portion of the entrance screen of the X-ray image intensifier tube is used, preferably a diaphragm arranged between the patient and the source is adapted to the smaller image format, so that unnecessary irradiation of parts of the patient which are not to be imaged is avoided. This is important for limiting the detrimental effects of radiation on living tissue as well as for a reduction of the X-rays scattered within the patient which reduce the image contrast. For adaptation of an image format of 38 cm to 17 cm, it is necessary to vary the voltage across at least one of the electrodes between, for example 3 kV and 35 kV by means of the adjusting means, in this case being a variable high-voltage power supply. In order to prevent the defocusing which accompanies the switch-over from becoming visible, switching-over should take place within the accommodation time of the human eye which amounts to approximately 0.2 s. This means that the output resistance of the high-voltage power supply, being connected parallel to the capacitance of the electrode whereto the high-voltage power supply is connected, should be small. A small output resistance, however, has the drawback that the dissipation therein is high, which impedes miniaturization of the high-voltage power supply and is detrimental to the long-term stability of the high-voltage power supply.

It is an object of the invention to provide an X-ray imaging system in which annoying visual effects are avoided when the image format is switched over. It is also an object of the invention to provide an X-ray imaging system in which the service life of the X-ray image intensifier tube is not affected by the switching-over of the format, the dissipation in the high-voltage power supply is comparatively small, and the high-voltage power supply is stable.

To achieve this, an X-ray imaging system in accordance with the invention is characterized in that the adjusting means are arranged to image, when a setting of the image of a first surface portion is changed to a setting of an image of a second surface portion, at least a third surface portion, having a size between that of the first and the second surface portions, onto the exit screen.

When one or more surface portions of intermediate size are imaged on the exit screen in a well-focused manner during switching over of the image format, a gradual increase or decrease of the image format is obtained while the object image remains well-focused so that observation is also possible during the changing of the image format. This is important for medical applications where a radiologist wishes to see a permanent image of the patient and does not wish to be distracted by adjusting effects, for example image flicker.

The gradual adjustment of the image format is also attractive for dose control whereby the mean light yield on the exit screen of the X-ray image intensifier tube is kept constant and also for automatic gain control of the video signal of the television camera. During dose control the light yield on the exit screen of the X-ray image intensifier tube is measured and the voltage of the X-ray source is adapted, in dependence on the thickness of the patient so as to achieve a constant mean brightness of the exit screen. This is necessary for correct exposure when images of the exit screen are recorded on photographic film and also for adequate illumination of the video camera. Because the voltage of the X-ray source may not be excessively increased for comparatively thick patients, the mean brightness on the exit screen of the X-ray image intensifier tube will then be lower than for thinner patients. The mean brightness of the video signal formed by the televison camera is kept constant in such cases by an automatic gain control (AGC). In the event of a sudden change-over of the image format of the X-ray image intensifier tube, the brightness of the exit screen of the X-ray image intensifier tube varies and the dose control and the automatic gain control may give rise to image-disturbing adjusting effects. This is counteracted by well-focused imaging of one or more intermediate image formats upon a change-over of the image format.

Furthermore, the charge displacements are comparatively small during the gradual adaptation of one or more voltages of the electron-optical system of the X-ray image intensifier tube and "flashing" of the X-ray image intensifier tube is prevented. "Flashing" occurs when, upon a fast voltage variation, electrons migrate, via insulator parts of the X-ray image intensifier tube, from an electrode carrying a high voltage to an electrode carrying a low voltage. Some ionization may then occur in the residual gases in the X-ray image intensifier tube; this is observed as an annoying, image-disturbing flash on the exit screen.

An embodiment of an X-ray imaging system in accordance with the invention in which the electron-optical system comprises an electrode, a voltage U(r) of which determines a size r of the surface portion imaged onto the exit screen, in which the adjusting means comprise a power supply circuit and an input circuit connected to the electrode, and in which an output voltage of the power supply circuit increases or decreases in response to an input signal to be formed by the input circuit, is characterized in that in order to change the size r of the surface portion imaged on the exit screen, the input signal is adapted by the input circuit so as to exhibit a variation r(t) which is continuous to the eye during a time interval dT, adaptation being such that the output voltage is substantially equal to the voltage U(r(t)) at any instant within the time interval dT.

Upon adjustment of the image format, the output resistance of the power supply circuit is connected parallel to the capacitance of the X-ray image intensifier tube, the power supply circuit and the cable between the X-ray image intensifier tube and the power supply circuit. When the power supply circuit and the X-ray image intensifier tube are integrated in a single housing, there will be no cables between the power supply circuit and the X-ray image intensifier tube. Because of the parallel-connected capacitance and the output resistance, in the event of a step-like variation of the input signal for the power supply circuit, to be formed by the input circuit, the output voltage of the power supply circuit increases or decreases exponentially with an RC-time which is determined by the output resistance and the capacitance. The invention is based inter alia on the insight that instead of aiming for a minimum RC-time of the power supply circuit for the benefit of a fast and invisible switching behaviour, choosing a slower, visible format adaptation allows for a longer RC-time which, as a result of the use of a high output resistance, leads to advantages such as lower dissipation in the power supply circuit and long-term stability.

Instead of adapting the image format according to the image format variation associated with the exponentially varying output voltage of the power supply circuit in response to a step-like variation of an input signal formed by the input circuit, it is often desirable to adopt a different variation in time, for example an image format which linearly increases or decreases in time. It is not possible to choose an arbitrary image format variation r(t), because the output voltage U(r) of the power supply circuit has a given inertia which is determined by the output resistance. The image format variation r(t) must be so slow that the variation per unit of time of the output voltage U(r(t)) to be supplied by the power supply circuit is smaller than the variation per unit of time of the exponential output signal of the supply voltage circuit due to a step-like variation of the input signal:

$$\frac{dU(0)e^{-t/\tau}}{dt} \geqq \frac{dU(r(t))}{dt} \quad (1)$$

Therein, $\tau$ is the RC-time of the power supply circuit coupled to the electrode and U(O) is the output voltage of the power supply circuit at the beginning of the image format variation. In the case of a linear format variation, for which r(t)=kt, the time derivative of U(r(t)) can be written as:

$$d\frac{U(r(t))}{dt} = \frac{dU(r)}{dr} \cdot \frac{dr}{dt} = \frac{dU(r)}{dr} \cdot k \quad (2)$$

The function of the voltage U in respect of the image format r is known from measurements and calculations. When from an instant t=0 and for a voltage U(0) of 35 kV the format is linearly increased from 17 cm to 38 cm (k=21) in a time interval of 1 s, and the maximum value of dU/dr occurs at t=0 and is given by 4000 $Vcm^{-1}$, it follows from the above formules for t=0 that $\tau$=0.4 s. For this RC-time, the output voltage of the power supply circuit can still follow the linear format variation. For a capacitance C of the electrode amounting to 150 pF, an output resistance R of the amplifier circuit amounting to a few GΩ can be used; this is very advantageous in view of power dissipation and stability of the power supply circuit.

An embodiment of an X-ray imaging system in accordance with the invention is characterized in that the input signal to be formed for the power supply circuit (63) by the input circuit (59, 61) is stepped.

For an RC-time amounting to 0.4 s, as from an instant t=0 a linear format variation from 17 cm to 38 cm can take place within one second in a number of N discrete steps having a duration Δt, where in accordance with the formule (1):

$$\frac{U(0)}{\tau} \geqq \frac{\Delta U(0)}{\Delta t} \quad (3)$$

Therein, U(0)=35 kV and ΔU(0) is the voltage step of the output voltage per time interval Δt at the nstant t=0. The voltage step per unit of time is greatest for the instant t=0, so that the time constant $\tau$ associated with this value in accordance with the formule (3) is small enough to allow the power supply circuit to follow the further voltage variation U(r(t)). For ΔU(0)=−377 V, the following value is found for Δt: Δt=1/232. The adaptation of the image format can take place in 332 equidistant steps.

A further embodiment of an X-ray imaging system in accordance with the invention is characterized in that the electron-optical system comprises several electrodes, each of which is connected to a respective power supply circuit whose input signals can be simultaneously adapted by the input circuit.

The X-ray image intensifier tube comprises, for example five electrodes whose voltage is to be adapted together in order to vary the image format. The X-ray image intensifier tube is notably made of metal and one of the electrodes is constantly connected to ground potential. The voltages across the five electrodes are stated for five image formats in the below Table. For adjustment of image formats intermediate of the five image formats, the voltages per electrode should be adjusted to the values of a voltage curve plotted through the five points. The electrode which is denoted as "anode 1" in the Table accelerates the electrons emitted by the cathode to a high speed; the electrode which is denoted as "anode 2" in the Table mainly determines the image format, the electrodes which are denoted as "focus 1" and "focus 2" have a focusing effect.

TABLE electrode voltages for five different image formats.

| Size [cm] | Anode 1 U [kV] | Anode 2 U [kV] | Focus 1 U [V] | Focus 2 U [V] | Cathode U [V] |
|---|---|---|---|---|---|
| 38 | 35.000 | 2.950 | 0 | 1800 | −198 |
| 31 | 35.000 | 7.390 | 0 | 1150 | −247 |
| 25,4 | 35.000 | 12.275 | 0 | 1115 | −266 |
| 20 | 35.000 | 22.860 | 0 | 1275 | −355 |
| 17 | 35.000 | 35.000 | 0 | 2000 | −375 |

A further embodiment of an X-ray imaging system in accordance with the invention is characterized in that the input circuit comprises a memory containing a Table in which voltage values are stored, for at least one electrode, for a number of N sizes of the surface portion of the entrance screen to be imaged, each size being represented by an address, and means for applying the electrode voltage values to the respective power supply circuits of the electrodes in a time sequence, the adjusting means comprising a format-adjusting circuit for receiving a format value of a new size to which the sub-surface to be imaged is to be adjusted and for supplying the memory with addresses associated with the sizes of the surface portions situated intermediate of the present size and the new size to be adjusted.

A user of the X-ray imaging system can apply a format value of an image format to be adjusted to the format adjusting circuit. A difference signal to be applied to the counter can be obtained by comparing the format value of the image format with a counter position which is a measure of the image format used. In dependence on the sign of the difference signal, the counter position is incremented or decremented until the difference signal is zero. The counter addresses the memory which stores the electrode voltage values which are associated with, for example 256 image formats. In response to each incrementation or decrementation of the counter, the counting speed being determined by the frequency of a clock connected to the counter, for each electrode a new voltage value is transferred from the memory, via a digital-to-analog converter, to the power supply circuit. The power supply circuit comprises, for example for each electrode with the exception of the electrodes carrying a fixed potential, an operational amplifier whose output is fed back, via a resistor, to the inverting input and whose gain is, for example 4000 times. After adjustment of the desired image format, if necessary, an analog fine adjustment signal can be applied to one or more electrodes in order to readjust the focusing to the desired accuracy.

A further embodiment of an X-ray imaging system in accordance with the invention is characterized in that the adjusting means comprise calibration means for determining a voltage variation as a function of the size of the surface portion for the at least one electrode, the calibration means comprising:

a variable power supply for applying a variable calibration signal to the power supply circuit of the at least one electrode in order to focus the image on the exit screen for different image formats, and arithmetic means for receiving calibration signals associated with a focused image of the various image formats on the exit screen and for determining the voltage values associated with the number of N sizes of the surface portion to be imaged from the voltage values adjusted by calibration.

The calibration means enable a user of the X-ray imaging system to adjust a number of voltages to be used for well-focused imaging. The voltages associated with intermediate image formats are calculated by calculation of a voltage curve as a function of the image format by means of the arithmetic means. For each individual X-ray image intensifier tube, an optimum voltage variation for the specific user as a function of the image format is thus obtained.

BRIEF DESCRIPTION OF THE DRAWINGS

Some embodiments of an X-ray imaging system in accordance with the invention will be described in detail hereinafter with reference to the accompanying drawing. Therein.

DETAILED DESCRIPTION

Figure 1:
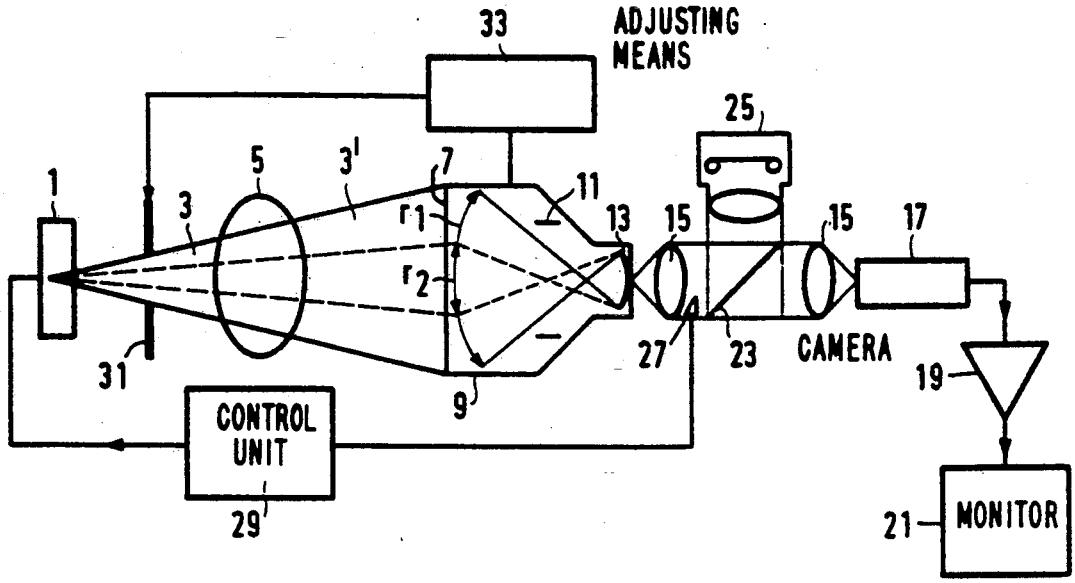
FIG. 1 shows diagrammatically an X-ray imaging system.

FIG. 1 shows an X-ray imaging system, comprising an X-ray source 1 which emits an X-ray beam 3 which irradiates an object 5, notably a patient. In the object 5 the X-ray beam 3 is attenuated in dependence on the local density in the object, so that an image-carrying X-ray beam 3' emanates from the object and is incident on an entrance screen 7 via a Ti-diaphragm of an X-ray image intensifier tube 9. The entrance screen 7 comprises a scintillation layer, for example of CsI, in which light is generated in dependence on the intensity of the X-rays and in which the X-ray image formed by the image-carrying X-ray beam 3' is detected. In order to enhance the brightness of the detected X-ray image, the light released in the scintillation layer is incident on a photocathode whereby electrons are emitted which are accelerated, via an electron-optical system comprising a number of electrodes 11, and are focused onto an exit screen 13. On the exit screen 13, comprising a phosphor layer, a brightness-intensified optical image is formed which is imaged, via an optical system 15, onto a photosensitive entrance screen of a television camera 17. The television camera 17 comprises, for example a solid-state sensor such as a CCD image sensor or a television camera tube having, for example a PbO entrance screen. The video signal formed by the television camera 17 is applied, via a video amplifier 19 with automatic gain control, to a television monitor 21. Via a semi-transparent splitting mirror 23, part of the light beam originating from the exit screen 13 is recorded onto the film of a 100-mm camera 25. In order to achieve correct exposure of the film in the camera 25 and of the entrance screen of the television camera 17 for different thicknesses of the patient 5, the mean brightness of the exit screen 13 is kept constant. To this end, a part of the light beam present between the lenses 15 is deflected by means of a prism 27 and is imaged onto a photodiode which is not shown in the Figure. The electric signal formed by the photodiode is applied to a control unit 29 which readjusts the high voltage and the current of the X-ray tube for as long as the brightness of the exit screen 13 deviates from a value desired for optimum exposure.

When volumes of the object 5 of different size are irradiated, it is advantageous to shield the part of the X-ray beam which is not used for imaging by means of a diaphragm 31; this is done from the point of view of patient exposure which should be minimum because of the detrimental effects of X-rays as well as from the point of view of scattered radiation generated in the patient. It is undesirable that dark edges occur on the exit screen 13 of the X-ray image intensifier tube 9 in the case of a small diaphragm setting of the diaphragm 30 or that, in the absence of the diaphragm 13, non-relevant details are visible in the X-ray image. In order to achieve this, the image format of the entrance screen of the X-ray image intensifier tube 9 is reduced by imaging a surface portion, having a diameter $r_2$ onto the exit screen 13. Via the adjusting means 13, the voltages of the electrodes of the electron-optical system 11 can be adjusted to, for example values associated with five image formats, a diameter $r_1$ of a maximum image format amounting to, for example 38 cm whereas a diameter $r_2$ of a minimum image format amounts to, for example 17 cm. A user of the X-ray imaging system can present the image format to be adjusted to the adjusting means 33, for example by way of a pushbutton or a monitor and keyboard or mouse, the adjusting means (33) then adjusting the position of the diaphragm 31 to the adjusted image format and the electrodes of the electron-optical system 11 receiving a voltage which varies in time so that to the eye a continuous, for example time-linear, variation of the image format takes place and the image on the exit screen can be observed without interruption.

Figure 2:
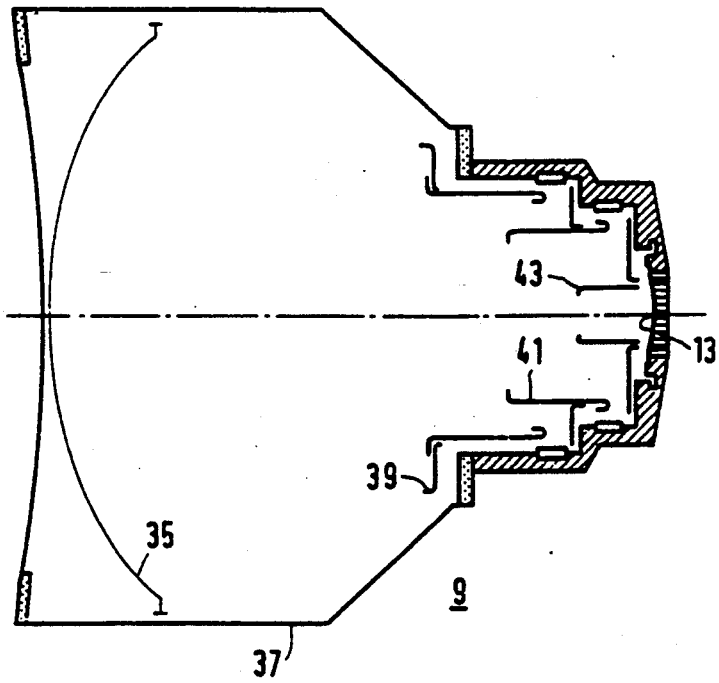
FIG. 2 is a lateral sectional view of an X-ray image intensifier tube.
Figure 3:
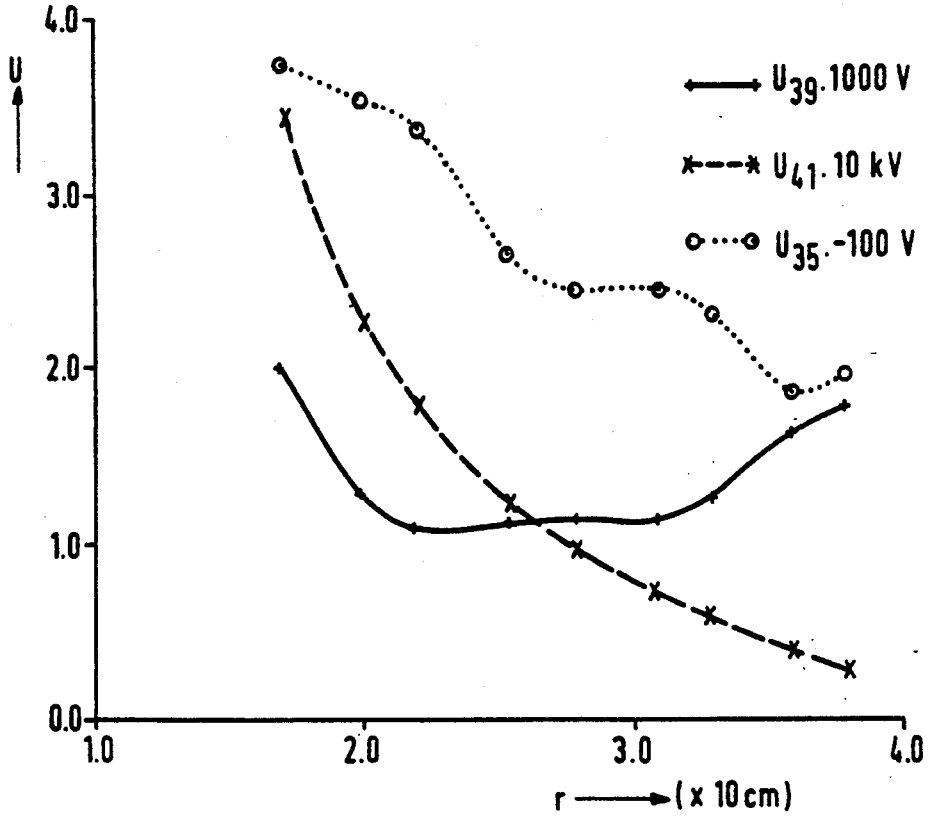
FIG. 3 shows voltage values for different electrodes of the X-ray image intensifier tube as a function of the image format.

FIG. 2 is a lateral sectional view of the X-ray image intensifier tube 9. The X-ray image intensifier tube 9 comprises five electrodes: a cathode 35 whose voltage is in the order of magnitude of −300 V, a first focusing electrode 37 having a constant voltage of 0 V, a second focusing electrode 39 whose voltage is in the order of magnitude of 2 kV, a format-adjusting electrode 41 whose voltage is variable from 3 kV to 35 kV, and an anode 43 carrying a constant voltage of 35 kV. The voltages U of the cathode 35, the second focusing electrode 39 and the format-adjusting electrode 41 are shown in FIG. 3 as a function of the image format r.

Figure 4:
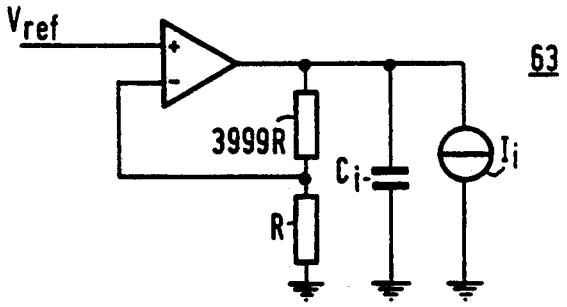
FIG. 4 shows a power supply circuit.
Figure 5A:
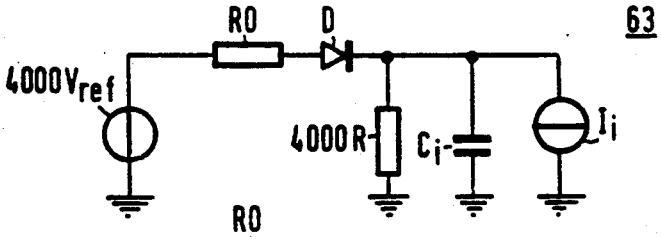
FIGS. 5*a*, 5*b* and 5*c* show an equivalent diagram of the power supply circuit for a steady image format, a decreasing image format and an increasing image format, respectively.
Figure 5B:
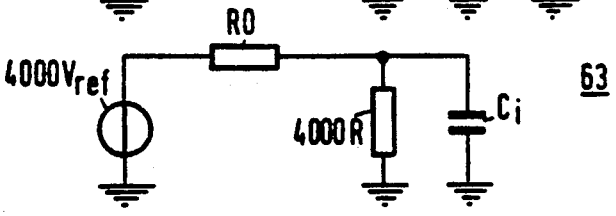
Figure 5C:
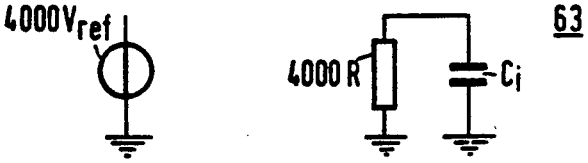
Figure 6:
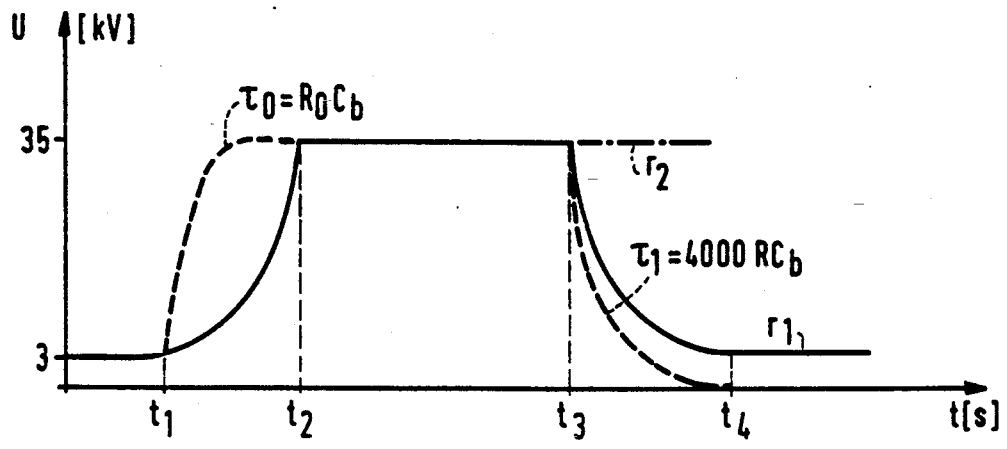
FIG. 6 shows the time-dependent voltage variation of a format adjusting electrode in response to a variation of the image format.

FIG. 4 shows diagrammatically a power supply circuit which forms part of the adjusting means 33, each electrode comprising a power supply circuit. The load of the electrode of the X-ray image intensifier tube can be represented as a current source $I_i$ which is connected parallel to a capacitance $C_i$. The input signal $V_{ref}$ appears amplified 4000 times at the output of the power supply circuit. In practice, a high output resistance R and a high voltage gain are achieved by utilizing a transformer and a rectifier circuit, so that the power supply circuit can be better represented by the diagram of FIG. 5a. In the diagram of FIG. 5a $R_0$ is the output resistance of the rectifier D, $R_0$ being much smaller than 4000R. For the switching-over from a large image format to a small image format, it can be deduced from FIG. 3 that the output voltage of the power supply circuit should increase for the format adjusting electrode 41. The equivalent diagram of the power supply circuit for switching over from a large to a small image format is shown in FIG. 5b in which the RC-time $\tau$ is approximated by $\tau = R_0C_i$. For switching over from a small image format to a large image format, the output voltage of the power supply circuit decreases and the equivalent diagram of the power supply circuit is given by FIG. 5c. Therein, the RC-time $\tau$ equals: $\tau = 4000RC_i$. The interrupted line in FIG. 6 denotes the time-dependent output voltage variation of the power supply circuit of the format-adjusting electrode 41 for a step-wise variation of the input voltage from 0.75 V to 8.75 V. In response to a step-wise variation of the input signal of the power supply circuit, the output voltage of the power supply circuit increases or decreases exponentially. When the output voltage increases, the RC-time is smaller than the RC-time in the event of a decrease of the output voltage, so that the increase and decrease of the image format as a function of time takes place dissimilarly in response to a step-wise variation of the input voltage. According to the known method of varying the image format, it is attempted to make this variation take place so that it is invisible to the eye. To this end, the RC-times $R_0C_i$ and $4000RC_i$ should be much smaller than the eye accommodation time which amounts to 0.2 s, so that the time intervals dT for switching over, between the instant $t_1$ and $t_2$ and between $t_3$ and $t_4$ in FIG. 6, are smaller than 0.2 s. The low output resistance of the power supply circuit, required for the small RC-times, however, is disadvantageous from the point of view of dissipation and long-term stability of the power supply circuit.

In accordance with the invention, the input voltage of the power supply circuit is varied so that the output voltage of the power supply circuit varies as denoted by the solid lines in FIG. 6, the time intervals dT for switching over, situated between $t_1$ and $t_2$ and between $t_3$ and $t_4$ in FIG. 6, amounting to, for example 1 s. It can be deduced from FIG. 3 that for a linear variation of the image format r(t) as a function of time, for which r=kt, the output voltage of the power supply circuit U(r(t)) varies in the same way as the output voltage U(r) of the format-adjusting electrode 41. The image format variation r(t) which is visible to the eye and which takes place within time intervals dT may also be non-linear, depending on the nature of the objects to be observed. FIG. 6 shows that for an image format variation r(t) within the time interval dT, the output voltage U(r(t)) of the power supply circuit, controlled via adaptation of the input signal of the power supply circuit, should satisfy the requirement given in formule (1). This is because the maximum variation of the output voltage of the power supply circuit is given by the exponential variation in time due to a step-wise adaptation of the input signal of the power supply circuit.

Figure 7:
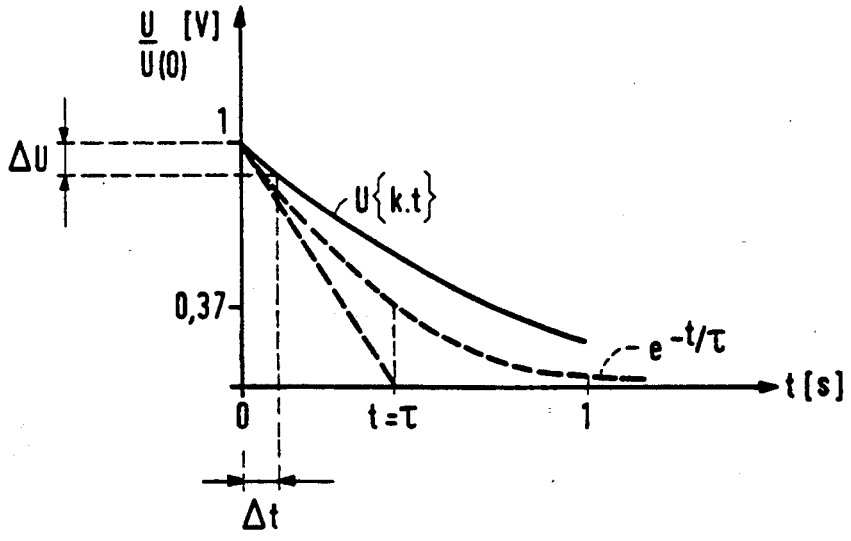
FIG. 7 shows the normalized voltage variation of the format adjusting electrode in response to a linear format variation, and the voltage variation of the format adjusting electrode in response to a step-like adaptation of the input signal of the power supply circuit.

FIG. 7 shows that for a linear decrease of the image format r from 38 to 17 cm within a time interval dT of 1 s, the output voltage of the power supply circuit exhibits the variation U(kt) denoted by the solid line. The variation U(kt) can be approximated by adaptation of the input signal of the power supply circuit in 255 steps $\Delta t$ of 1/255 second. The time derivative of U(kt) is greatest for $t=0$, so that for the instant $t=0$ the formule (1) becomes the formule (3). The smallest RC-time $\tau$ found for $U(0)=35$ kV, $\Delta U(0)=-377$ V, $\Delta t=1/255$ is 364 ms. For a capacitance $C_i$ of the X-ray image intensifier tube amounting to 150 pF and a capacitance of the power supply cable between the electrode and the power supply circuits of the power supply circuit itself amounting to 174 pF, the maximum value of the output resistance 4000R that can be used equals a few GΩ.

Figure 8:
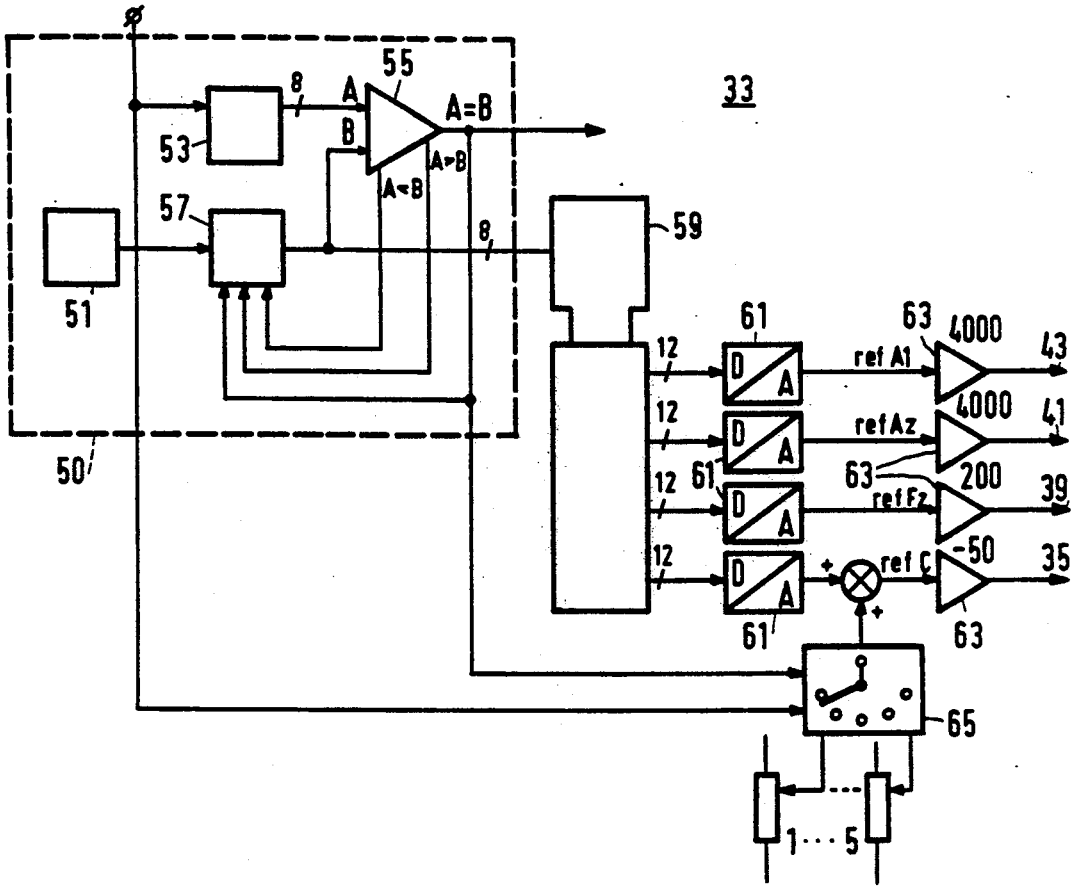
FIG. 8 shows an embodiment of adjusting means in accordance with the invention.

FIG. 8 shows the adjusting means 33, comprising a format-adjusting circuit 50 which includes a clock circuit 51, an input circuit 53, a comparator circuit 55, a counter 57, a memory 59, four digital-to-analog converters 61, and four power supply circuits 63. The memory 59 comprises for example an EPROM and stores the voltage curves for the electrodes 35, 39 and 41, shown in FIG. 3, in three tables at 256 addresses, each of which corresponds to an image format r. The voltage across the electrode 43 is constant. The clock circuit 51 applies clock pulses at a frequency of 256 Hz to the counter 8 which counts up and down and which forms an eight-bit address after each clock pulse, which address is applied to the address input of the memory 59. When the memory 59 is addressed, four voltage values stored in the address storage space are applied, via the digital-to-analog converter 61, as an input signal to the power supply circuits 63. After amplification by 4000, 200 or −50 times, the input signal is applied, via the power supply circuits, to the associated electrode 35, 39, 41 or 43. Via the input circuit 53, a user can select five image formats by applying five format codes to the input circuit. In the input circuit 53 the format code is converted into a format value which corresponds to one of the 256 addresses of the memory 59. In the comparator circuit 55 the format value is compared with the position of the counter 57, the difference between the instantaneously used image format and the new image format to be adjusted thus being determined. Depending on whether the new image format to be adjusted is larger or smaller, the counter 57 is activated so as to count up or down, so that the addresses of the memory 59 are step-wise incremented or decremented. When the position of the counter 53 equals the format value adjusted via the input circuit 55, the counter is stopped and the image format becomes stationary. For fine adjustment of the focusing of the image formed on the exit screen 13 of the X-ray image intensifier tube 9, the cathode 35 is connected to a fine-adjusting voltage, via a multiplexer 65, after completion of a change of format.

Figure 9:
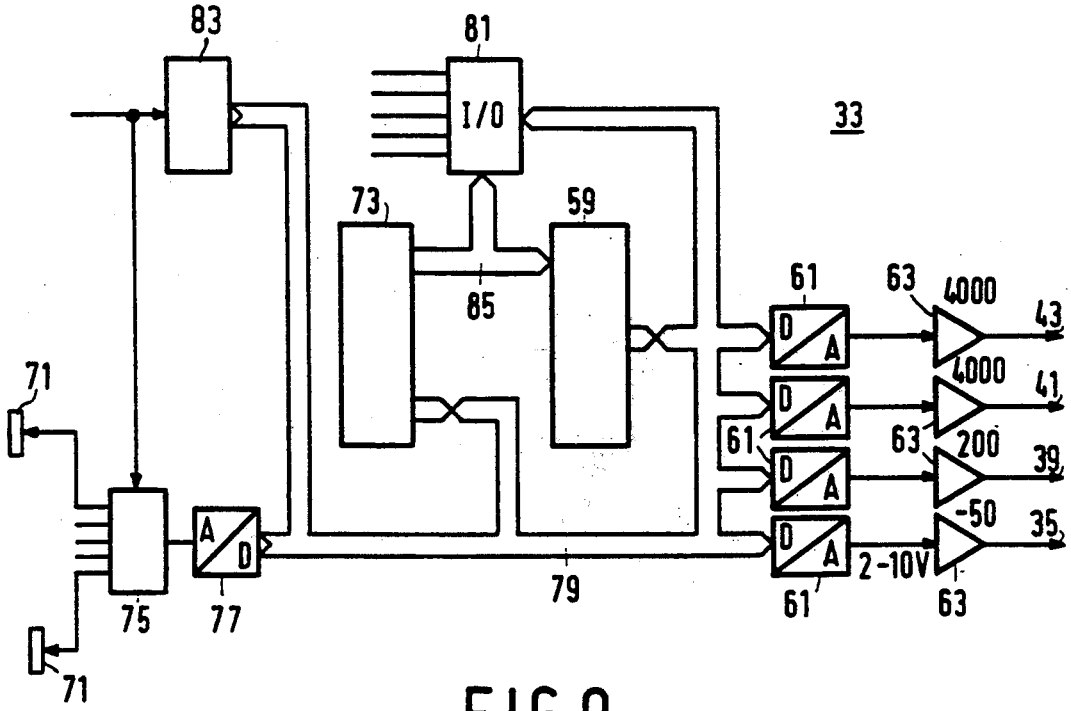
FIG. 9 shows an alternative embodiment of adjusting means in accordance with the invention.

FIG. 9 shows the adjusting means 33, calibration means being provided for applying five variable voltage values to the cathode 35. For a predetermined image format a voltage is applied from a variable power supply, in this case comprising a variable resistor 71, via a multiplex circuit 75 and an analog-to-digital converter 77, to a power supply circuit 63 of the cathode 35, via a data bus. The user adjusts the variable resistor 71 so that a well-focused, steady image is observed on the exit screen 13 of the X-ray image intensifier tube 9. The voltage values thus adjusted are stored in the arithmetic means which comprise a microprocessor 73 in which the voltage values fit a curve, so that the voltage variation shown in FIG. 3 for the cathode 35 is obtained for, for example 256 image formats. Via the data bus 79, the voltage values are stored in the memory 59. In the case of a change of image format, the addresses of the memory 59 are generated in the microprocessor 73, which addresses are applied thereto via an address bus 85. Because the microprocessor determines, at least for the cathode 35, the voltage variation as a function of the image format r from five voltage values to be finely adjusted by the user, an individual, optimum image format adjustment can be obtained for each X-ray image intensifier tube.

An external data bus can be connected, via a circuit 81, for example for service purposes, so that the contents of the memory 59 can be observed or the operation of the microprocessor 73 can be checked.

I claim:

1. An X-ray imaging system, comprising:

an X-ray source (1) for emitting an X-ray beam 3) for irradiating an object (5) to be arranged within the X-ray beam so as to form an X-ray image;

an X-ray image intensifier tube (9), comprising an entrance screen (7) for the detection the X-ray image and the emission of electrons, an exit screen (13), and an electron-optical system (11) for imaging the X-ray image detected on the entrance screen as an optical image onto the exit screen (13), and adjusting means (33) for adjusting the electron-optical system (11) so as to image surface portions ($r_1$, $r_2$) of different sizes of the entrance screen onto the exit screen, characterized in that the adjusting means (33) are arranged to image, when a setting of the image of a first surface portion is changed to a setting of an image of a second surface portion, at least a third surface portion, having a size between that of the dimensions of the first and the second surface portions, onto the exit screen (13).

2. An X-ray imaging system as claimed in claim 1, in which the electron-optical system (11) comprises an electrode (41), a voltage U(r) of which determines a size r of the surface portion imaged onto the exit screen (13), in which the adjusting means (33) comprise a power supply circuit (63) and an input circuit (59, 61) connected to the electrode (41), and in which an output voltage of the power supply circuit (63) increases or decreases in response to an input signal to be formed by the input circuit (59, 61), characterized in that in order to change the size r of a surface portion imaged on the exit screen, the input signal is adapted by the input circuit (59, 61) so as to exhibit a variation r(t) which is continuous to the eye during a time interval dT, adaptation being such that the output voltage is substantially equal to the voltage U(r(t)) at any instant within the time interval dT.

3. An X-ray imaging system as claimed in claim 2, characterized in that the input signal to be formed for the power supply circuit (63) by the input circuit (59, 61), is a stepped signal.

4. An X-ray imaging system as claimed in claim 3, characterized in that the time interval between two successive input signal steps is constant.

5. An X-ray imaging system as claimed in claim 2, characterized in that the electron-optical system (11) comprises several electrodes (35–43) including the aforementioned electrode (41), each of which is connected to a respective power supply circuit (63) whose input signals can be simultaneously adapted by the input circuit (59, 61).

6. An X-ray imaging system as claimed in any one of the claim 2, characterized in that the input circuit (59,61) comprises a memory (59) containing a table in which voltage values are stored, for said electrode (41), for a number of N sizes of the surface portion of the entrance screen (7) to be imaged, each being represented by an address and means for applying the electrode voltage values to the power supply circuit (63) in a time sequence, the adjusting means comprising a format-adjusting circuit (50) for receiving a format value of a new size which the surface portion to be images is to be adjusted and for supplying the memory (59) with addresses associated with the sizes of the surface portions intermediate of the present size and the new size to be adjusted.

7. An X-ray imaging system as claimed in claim 6, characterized in that the format-adjusting circuit (50) comprises a clock (51) for applying clock pulses to a counter (57) whose output is coupled to the memory (59) in order to supply the memory with address values and to an input of a comparator circuit (55) for comparing the counter signal with the new format value to be adjusted, an output of the comparator circuit (55) being coupled to the counter (57) in order to adjust the counting direction and to block the counter when the counter signal equals the new format value to be adjusted.

8. An X-ray imaging system as claimed in claim 6, characterized in that the format value is applied to a multiplex circuit (65) for applying a fine-adjustment signal to said electrode when the size of the surface portion is stationary after adjustment.

9. An X-ray imaging system as claimed in claim 6, characterized in that the adjusting means (33) comprise calibration means (71, 73, 75) for determining a voltage variation as a function of the size of the surface portion for the at least one electrode, the calibration means comprising:

a variable power supply (71) for applying a variable calibration signal to the power supply circuit (63) of the at least one electrode in order to focus the image on the exit screen for different image formats, and arithmetic means (73) for receiving calibration signals associated with a focused image of the various image formats on the exit screen (13) and for determining the voltage values associated with the number of N sizes of the surface portion to be imaged from the voltage values adjusted by calibration.

10. An X-ray imaging system as claimed in claim 5, characterized in that the input circuit (59, 61) comprises a memory (59) containing a table in which voltage values are stored, for at least one electrode (41), for a number of N sizes of the surface portion of the entrance screen (7) to be imaged, each being represented by an address and means for applying the electrode voltage values to be respective power supply circuit (63) said electrodes (35–43) in a time sequence, the adjusting means comprising a format-adjusting circuit (50) for receiving format value of a new size to which the surface portion to be images is to be adjusted and for supplying the memory (59) with addresses associated with the sizes of the surface portions intermediate of the present size and the new size to be adjusted.

11. An X-ray imaging system as claimed in claim 10, characterized in that the format-adjusting circuit (50) comprises a clock (51) for applying clock pulses to a counter (57) whose output is coupled to the memory (59) in order to supply the memory with address values and to an input of a comparator circuit (55) for comparing the counter signal with the new format value to be adjusted, an output of the comparator circuit (55) being coupled to the counter (57) in order to adjust the counting direction and to block the counter when the counter signal equals the new format value to be adjusted.

12. An X-ray imaging system as claimed in claim 10, characterized in that the format value is applied to a multiplex circuit (65) for applying a fine-adjustment signal to at least one of the electrodes when the size of the surface portion is stationary after adjustment.

13. An X-ray device comprising an X-ray image intensifier tube (9), having an entrance screen (7) for detecting X-ray image and emitting electrons in response thereto, an exit screen (13), and an adjusting means (33) for adjusting the electron-optical system (11) so as to image surface portions ($r_1$, $r_2$) of different sizes of the entrance screen onto the exit screen, characterized in that the adjusting means (33) are arranged to image, when a setting of the image of a first surface portion is changed to a setting of an image of a second surface portion, at least a third surface portion, having a size between that of the dimensions of the first and the second sufface portions, onto the exit screen (13).

* * * * *